US008944880B2

(12) United States Patent
LaSalle

(10) Patent No.: US 8,944,880 B2
(45) Date of Patent: Feb. 3, 2015

(54) APPARATUS FOR DISTRIBUTING SCALE BALLAST ON A MODEL RAILROAD TRACK

(76) Inventor: Anthony LaSalle, Overland Park, KS (US)

( * ) Notice: Subject to any disclaimer, the term of this patent is extended or adjusted under 35 U.S.C. 154(b) by 491 days.

(21) Appl. No.: 13/273,024

(22) Filed: Oct. 13, 2011

(65) Prior Publication Data

US 2012/0094573 A1 Apr. 19, 2012

Related U.S. Application Data

(60) Provisional application No. 61/392,573, filed on Oct. 13, 2010.

(51) Int. Cl.

| | |
|---|---|
| ***A63H 17/14*** | (2006.01) |
| ***A63H 19/15*** | (2006.01) |
| ***A63H 19/36*** | (2006.01) |

(52) U.S. Cl.

CPC ..... *A63H 19/15* (2013.01); *A63H 19/36* (2013.01)

USPC ..... 446/427; 446/431; 446/467

(58) Field of Classification Search

USPC ..... 446/424, 427, 431, 467

See application file for complete search history.

(56) References Cited

U.S. PATENT DOCUMENTS

| | | | | | |
|---|---|---|---|---|---|
| 195,217 | A | * | 9/1877 | Isaacs | 15/54 |
| 1,483,674 | A | * | 2/1924 | Owen | 171/15 |
| 2,253,610 | A | * | 8/1941 | Coderre | 446/447 |
| 2,475,771 | A | * | 7/1949 | Wittner | 104/279 |
| 2,725,668 | A | * | 12/1955 | Bonanno | 446/427 |
| 2,739,542 | A | * | 3/1956 | Bonanno | 105/238.2 |
| 3,757,464 | A | * | 9/1973 | Gagnon | 446/427 |
| 5,579,593 | A | * | 12/1996 | Murray | 37/104 |
| 5,816,168 | A | * | 10/1998 | Poissant | 104/279 |
| RE36,685 | E | * | 5/2000 | Bounds | 105/311.1 |
| 6,110,050 | A | * | 8/2000 | Tammera | 472/71 |
| 6,536,355 | B1 | * | 3/2003 | Amemiya | 105/1.5 |
| 6,554,681 | B1 | * | 4/2003 | Tammera | 446/288 |
| 6,592,427 | B1 | * | 7/2003 | Wilhelm et al. | 446/427 |
| 6,758,145 | B1 | * | 7/2004 | Hefter | 104/279 |

* cited by examiner

*Primary Examiner* — Gene Kim
*Assistant Examiner* — Joseph B Baldori
(74) *Attorney, Agent, or Firm* — William W. Lewis, III

(57) ABSTRACT

An apparatus for distributing scale ballast over a model railroad track includes a hopper configured to funnel scale ballast to a spreader assembly, the spreader assembly including a spreader aperture formed between a compactor brush and a spreader plate, a chassis and a pair of contour skirts configured to contour scale ballast along the sides of the model railroad track.

20 Claims, 4 Drawing Sheets

APPARATUS FOR DISTRIBUTING SCALE BALLAST ON A MODEL RAILROAD TRACK

CROSS-REFERENCE TO RELATED APPLICATIONS

This application claims priority to U.S. Provisional Patent Application 61/392,573, entitled Apparatus For Distributing Scale Ballast on a Railroad Track, filed Oct. 13, 2010.

BACKGROUND OF THE INVENTION

Model railroad enthusiasts desire to create realistic model layouts that resemble full sized railroad lines. One detailed element of a realistic model railroad track layout involves applying track ballast along the model track. In the case of full size railroad tracks, track ballast is generally made of crushed stone such as granite and the edges of the stone particles interlock with each other to stay in place. Track ballast is packed between, below, and around track ties and is used to facilitate drainage of water, to distribute the load from the railroad ties, and also to keep down vegetation that might interfere with the track structure. Additionally, track ballast also aids in keeping the railroad track stationary as a train rolls along the tracks.

Presently, there are different techniques for applying railroad ballast to a model track layout, but most tend to involve some variation of what winds up being a long, laborious process done by hand. For example, one technique involves the use of a small teaspoon, one or more brushes, and a vacuum cleaner. The spoon is used to hold a small amount of dry ballast directly over the model track and is gently tapped so that the ballast sprinkles out a little at a time over the inside of the rails followed by the outside of the rails, all while trying to keep the outside edges of the ballast neat and straight. The spoon is followed by use of a brush to spread the ballast in and around the ties both on the inside of the rails and out while attempting to keep the outside edges neat and straight. The vacuum is used to clean up the mess caused by the ballast that has spilled out onto the floor and areas of the model track layout during the previous steps.

In sum, present ballast laying methods can be time consuming and involve hours of work to apply ballast to relatively small portion of a model track layout.

SUMMARY OF THE INVENTION

In accordance with one embodiment of the present invention, an apparatus for distributing scale ballast over a model railroad track is provided that includes a chassis with leading and trailing truck assemblies configured to travel along the rails of the model railroad track, a hopper configured to funnel scale ballast to a spreader assembly, the spreader assembly including a spreader aperture formed between a compactor brush and a spreader plate wherein the compactor brush is configured to compact the scale ballast into the ties of the model railroad track and the spreader plate is slotted to engage the rails of the model railroad track, and a pair of contour skirts configured to contour scale ballast along the sides of the model railroad track.

In accordance with another embodiment of the present invention, further provided is an apparatus for distributing scale ballast over a model railroad track, including a weighted chassis, one or more wheeled trucks mounted to the weighted chassis, a hopper, a plate comprising one or more grooves at a first end to engage the rails of a model railroad track, a compactor brush configured to compact the scale ballast into the ties of the model railroad tracks, and a spreader aperture formed between the compactor brush and the plate.

In accordance with yet another embodiment of the present invention, an apparatus for distributing scale ballast over a model railroad track is provided where the apparatus includes a chassis configured to engage and travel along rails of the model railroad track, a spreader plate member, a compactor brush, a spreader aperture formed by a gap between the spreader plate member and the compactor brush, a hopper configured to funnel scale ballast to the spreader aperture, and a pair of contour skirts configured to contour scale ballast along the sides of the model railroad track.

There has thus been outlined, rather broadly, certain embodiments of the invention in order that the detailed description herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE SEVERAL VIEWS OF THE DRAWING

Further features of the present invention will become apparent to those skilled in the art to which the present invention relates from reading the following description with reference to the accompanying drawings, in which.

DETAILED DESCRIPTION OF THE INVENTION

Figure 1:
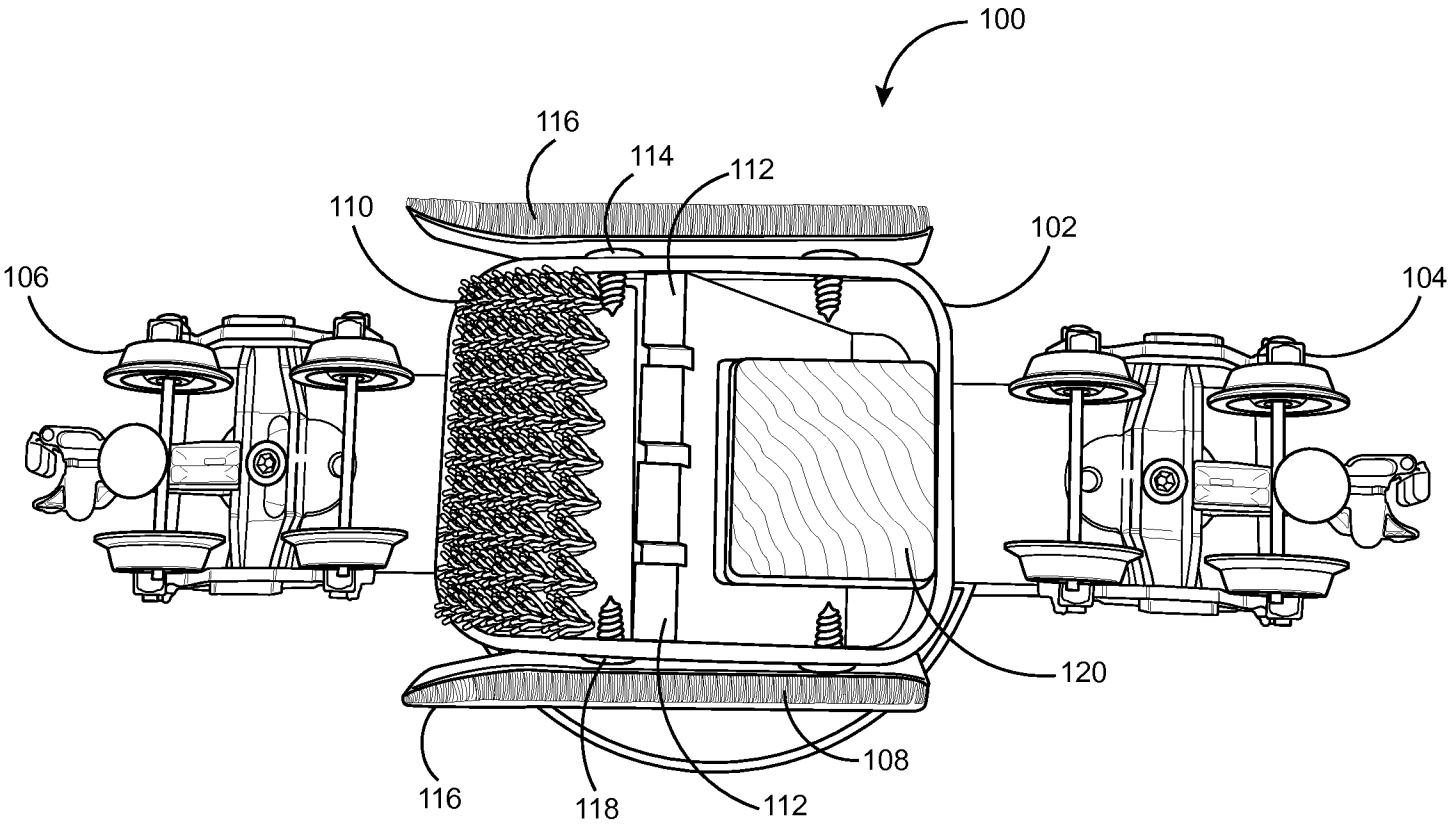
FIG. 1 is a profile view of the underside of an apparatus for distributing scale ballast according to an embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the Figures.

Turning to FIG. 1, shown is a profile view of the underside of an apparatus 100 for distributing scale ballast according to an embodiment of the present invention. As shown, the apparatus 100 includes a chassis 102 connected to a leading truck 104 and a trailing truck 106. The leading 104 and trailing 106 trucks are configured to travel along the rails of a model railroad track. While model railroad trucks, also known as wheels, are shown it will be appreciated that the apparatus may travel along the rails of a track using one or more rollers, a slideable chassis or other sled-like arrangement for sliding the apparatus along the rails of a track. As such the term truck, as used herein is not limited to an assembly requiring one or more wheels. As shown, the trailing truck 106 is mounted to the chassis 102 in a manner that permits some lateral movement to either side so that the spreader assembly stays in contact with the rails of the track when going around a curve in the track.

A hopper 108 is connected to the chassis 102 and configured to hold a quantity of scale ballast. The scale ballast is applied to the track via a spreader assembly comprised of a spreader aperture 114 formed between a compactor brush 110 and a spreader plate 112. The spreader assembly generally evenly spreads ballast across and along the tracks. The compactor brush 110 is made of brass, steel, synthetic, or other similar material and forces the ballast between the tracks and the railroad ties. The spreader plate 112 includes one or more grooves to engage the rails of the track.

Additionally, the apparatus 100 includes a pair of side contour skirts 116 that extend slightly beyond the edges of a model railroad track and are adjustably fixed via mounts 118. In the depicted embodiment the side contour skirts 116 are a pair of opposing lateral brushes and are used to contour and contain the ballast.

In the depicted embodiment, a positioning block 120 is used to adjustably secure the position of the spreader plate 112. The relative height of the spreader plate 112 is adjustable so that the apparatus 100 may accommodate rail heights that may differ by manufacturer. Additionally, the size of ballast granules may vary, so the size of the gap of the spreader aperture 114 may be adjusted accordingly. One way that the size of the spreader aperture 114 gap may be adjusted is via use of a hinged spreader plate 112.

In use, the apparatus 100 is placed onto a model railroad track and is pressed down so the leading 102 and trailing 104 trucks are contacting the track evenly, the compactor brush 110 is seated, and the spreader plate 112 is in contact with the rails of the track. The hopper 108 is then filled with ballast, which may be granite as used in full sized railroads, but ground to scale. While pressing down, the apparatus 100 is moved forward along the model track and may provide some resistance to movement as the compactor brush 110 forces the ballast down between the ties of the railroad tracks and the side contour skirts 116 form the shoulders of the roadbed. Additionally, a plastic water pitcher may be used to replenish the ballast as apparatus 100 moves along the track.

The apparatus 100 can be built for all scales and gauges in the model train industry, including but not limited to: G, O, HO, S, N, and Z gauges. Construction is metal, plastic, brass, and rubber, but not limited to those materials. In some embodiments, the apparatus 100 resembles a maintenance of way railroad car.

Figure 2:
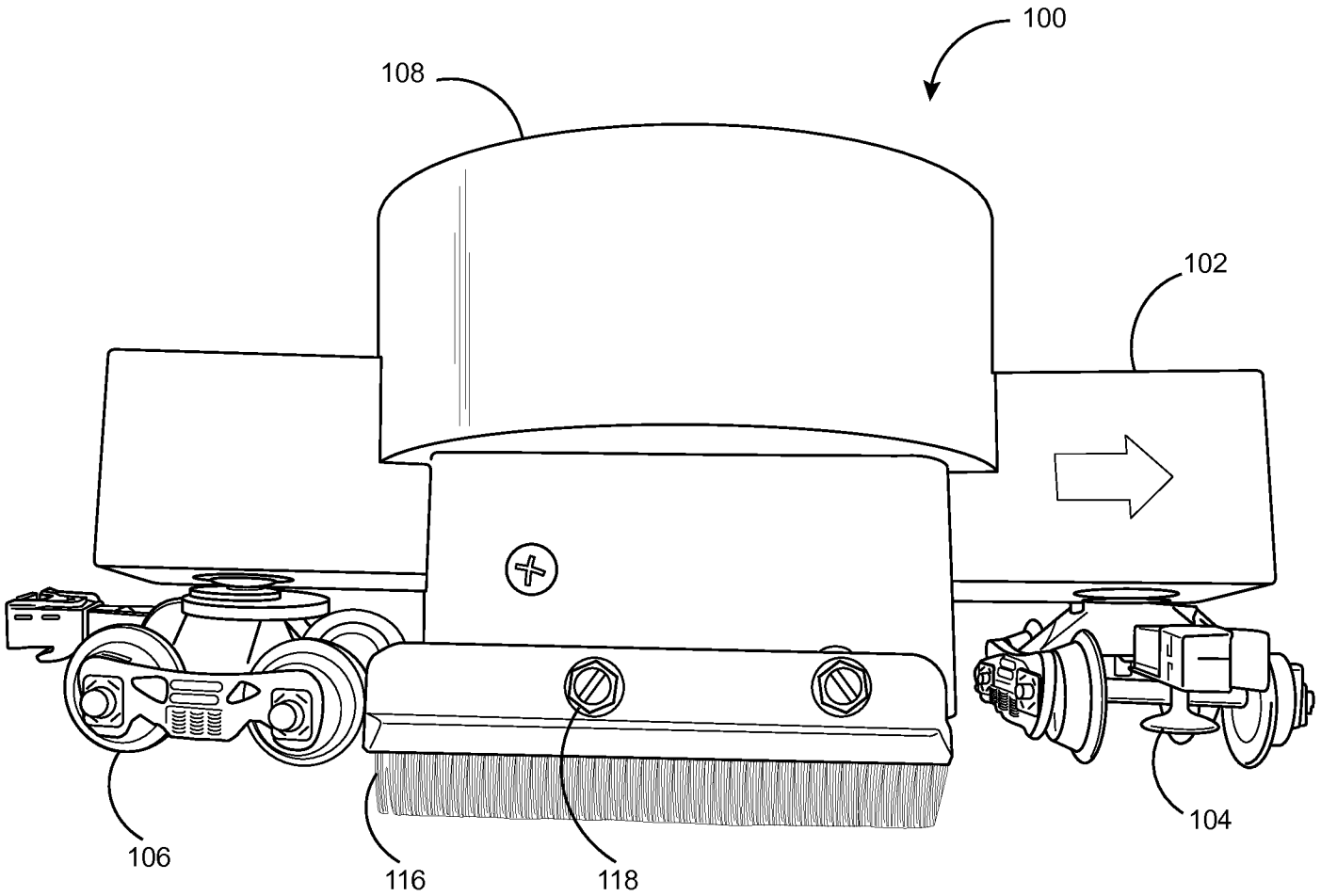
FIG. 2 is a side profile view of an apparatus for distributing scale ballast according to an embodiment of the present invention.

Turning to FIG. 2, an apparatus 100 for distributing scale ballast according to an embodiment of the present invention is shown in side profile. The chassis 102 is connected to leading 104 and trailing 106 trucks and supports a hopper 108. A variety of materials may be used for the chassis 102 in order to provide enough weight to maintain contact between the rails of the track and the leading 104 and trailing 106 truck assemblies. The chassis 102 as shown is constructed from a steel bar.

Side contour skirts 116 are connected to the apparatus 100 via mounts 118. According to some embodiments, the side contour skirts 116 include one or more mounting slots to receive mounts 118, thereby allowing the relative height of the side contour skirts 116 to be adjusted to accommodate various track layouts and rail heights. Additionally, some embodiments feature a side contour skirt 116 that permits a least a portion of the side contour skirt 116 to be customized laterally as well. As shown, the trailing end of the side contour skirts 116 has been bent slightly outward to adjust the resulting rail bed shape.

Figure 3:
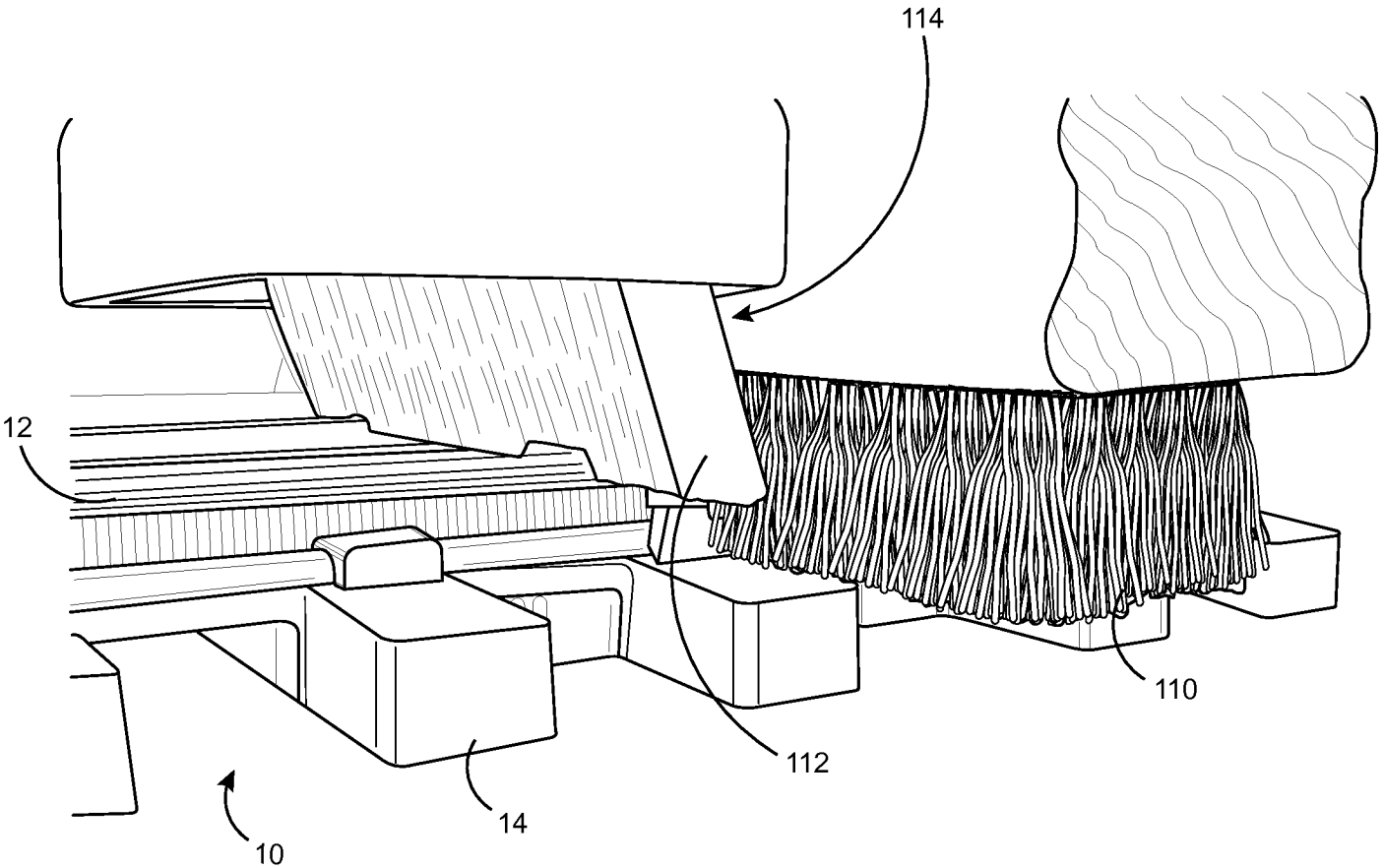
FIG. 3 is a partial perspective view of an apparatus with lateral brushes removed for distributing scale ballast placed on a model railroad track in accordance with an embodiment of the present invention.

In FIG. 3, a partial perspective view is provided that illustrates a section of model railroad track 10 with rails 12 and ties 14 in contact with an apparatus in accordance with an embodiment of the present invention. The side contour skirt has been removed for this view. In the depicted embodiment, a spreader plate 112 with two grooves is shown in contact with the rails 12 and compactor brush 110 is seated against the ties 14. Ballast is laid onto a selected portion of the track 10 through the spreader aperture 114. It will be appreciated that some embodiments of the present invention feature a closeable spreader aperture to stop the flow of ballast.

In use, ballast is applied to a selected portion of the track via the spreader aperture 114 formed by the compactor brush 110 and the spreader plate 112. As the apparatus 100 is moved along the track, the compactor brush 110 forces the ballast down between the ties 14 of the railroad track 10.

Figure 4:
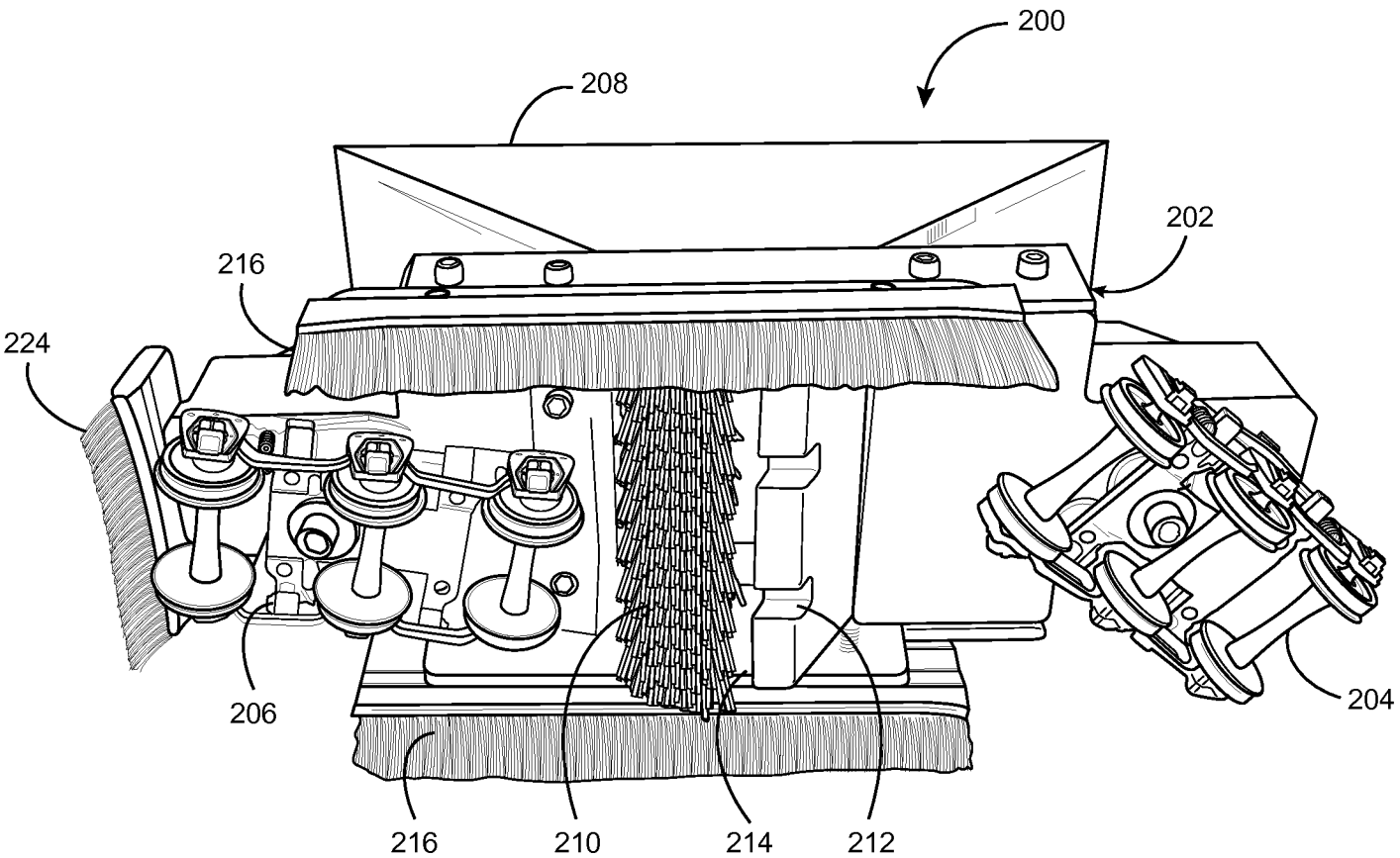
FIG. 4 is a perspective view of the underside of an apparatus distributing scale ballast in accordance with another embodiment of the present invention.

Turning to FIG. 4, shown is a perspective view of the underside of an apparatus 200 for distributing scale ballast according to an alternate embodiment of the present invention. As shown, the apparatus 200 includes a chassis 202 connected to a leading truck 204 and a trailing truck 206. The leading 204 and trailing 206 trucks are configured to travel along the rails of a model railroad track. A hopper 208 is connected to the chassis 202 and configured to hold a quantity of scale ballast. The scale ballast is applied to the track through a spreader aperture 214 formed between a compactor brush 210 and a spreader plate 212.

As shown, a pair of side contour skirts 216 are adjustably configured to extend slightly beyond the sides of a model railroad track. In this embodiment, a trailing brush 224 is shown mounted to the apparatus 200.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An apparatus for distributing scale ballast over a model railroad track, the apparatus comprising:

a chassis with leading and trailing truck assemblies configured to travel along the rails of the model railroad track;

a hopper configured to funnel scale ballast to a spreader assembly, said spreader assembly comprising a spreader aperture formed between a compactor brush and a slotted spreader plate wherein said compactor brush is at least as wide as the model railroad track and is configured to compact the scale ballast into the ties of the model railroad track and said slotted spreader plate comprises a plurality of slots at a first end configured to engage the rails of the model railroad track and position the remainder of the first end of the slotted spreader plate below the top of the rails; and a pair of contour skirts configured to contour scale ballast along the sides of the model railroad track.

2. The apparatus of claim 1 wherein said chassis is weighted to maintain contact between the model track rails and said leading and trailing truck assemblies.

3. The apparatus of claim 1 wherein said slotted spreader plate position is adjustable.

4. The apparatus of claim 1 wherein said spreader aperture size is adjustable.

5. The apparatus of claim 1 wherein said pair of contour skirts comprises a pair of laterally mounted brushes.

6. The apparatus of claim 1 wherein said trailing truck assembly permits a predetermined amount of lateral movement.

7. The apparatus of claim 1 wherein said spreader assembly width extends to the edges of the model railroad track.

8. An apparatus for distributing scale ballast over a model railroad track, the apparatus comprising:

a weighted chassis;

one or more wheeled trucks mounted to said weighted chassis;

a hopper;

a plate comprising a plurality of grooves at a first end configured to encompass the rails of a model railroad track with the remainder of the first end of the spreader plate member below the top of the rails;

a compactor brush configured to compact the scale ballast into the ties of the model railroad tracks, wherein the compactor brush is at least as wide as the model railroad track; and a spreader aperture formed between said compactor brush and said plate.

9. The apparatus of claim 8 further comprising a pair of opposing lateral brushes configured to contour the scale ballast along the sides of the model railroad track.

10. The apparatus of claim 9 wherein said opposing lateral brushes are adjustably fixed to the apparatus via slots to permit a limited range of up and down movement.

11. The apparatus of claim 8 wherein said plate position is adjustable.

12. The apparatus of claim 8 wherein said spreader aperture size is adjustable.

13. The apparatus of claim 8 wherein said at least one of said wheeled trucks permits a predetermined amount of lateral movement.

14. An apparatus for distributing scale ballast over a model railroad track, the apparatus comprising:

a chassis configured to engage and travel along rails of the model railroad track;

a spreader plate member comprising a plurality of slots at a first end configured to encompass the rails of the model railroad track with the remainder of the first end of the spreader plate member below the top of the rails;

a compactor brush;

a spreader aperture formed by a gap between said spreader plate member and said compactor brush;

a hopper configured to funnel scale ballast to said spreader aperture; and a pair of contour skirts configured to contour scale ballast along the sides of the model railroad track.

15. The apparatus of claim 14 wherein said pair of contour skirts are adjustably fixed to the apparatus via slots to permit a limited range of up and down movement.

16. The apparatus of claim 14 wherein said pair of contour skirts comprises a pair of laterally mounted brushes.

17. The apparatus of claim 14 wherein said spreader aperture size is adjustable.

18. The apparatus of claim 14 wherein said spreader plate member position is adjustable.

19. The apparatus of claim 14 further comprising a truck mounted to said chassis where said truck permits a predetermined amount of lateral movement.

20. The apparatus of claim 14 wherein said compactor brush is as wide as the model railroad tracks.

* * * * *